US006824431B2

(12) United States Patent
Shimada et al.

(10) Patent No.: US 6,824,431 B2
(45) Date of Patent: Nov. 30, 2004

(54) CARD ADAPTER

(75) Inventors: Tsutomu Shimada, Tokyo (JP); Kaname Suwa, Kanagawa (JP); Tsuguhide Sakata, Kanagawa (JP); Atsushi Nishio, Ibaraki (JP); Takashi Kawasaki, Ibaraki (JP); Kazuhiro Okazaki, Ibaraki (JP)

(73) Assignees: Canon Kabushiki Kaisha, Tokyo (JP); Mitsumi Electrical Co., LTD, Tokyo (JP)

( * ) Notice: Subject to any disclaimer, the term of this patent is extended or adjusted under 35 U.S.C. 154(b) by 25 days.

(21) Appl. No.: 10/207,477

(22) Filed: Jul. 29, 2002

(65) Prior Publication Data

US 2003/0022557 A1 Jan. 30, 2003

(30) Foreign Application Priority Data

Jul. 30, 2001 (JP) ..... 2001-230069

(51) Int. Cl.[7] ..... H01R 24/00

(52) U.S. Cl. ..... 439/630; 439/628; 439/638; 439/101; 439/108; 439/109; 439/159

(58) Field of Search ..... 439/630, 628, 439/638, 159, 101, 108, 109

(56) References Cited

U.S. PATENT DOCUMENTS

| | | | | | |
|---|---|---|---|---|---|
| 5,846,092 | A | * | 12/1998 | Feldman et al. | 439/76.1 |
| 6,109,931 | A | | 8/2000 | Yotsutani | 439/76.1 |
| 6,109,940 | A | * | 8/2000 | Chad et al. | 439/141 |
| 6,139,338 | A | * | 10/2000 | Hirai et al. | 439/141 |
| 6,149,450 | A | * | 11/2000 | Gastineau | 439/325 |
| 6,231,360 | B1 | * | 5/2001 | Horie | 439/159 |

FOREIGN PATENT DOCUMENTS

JP 11-251019 2/1998

* cited by examiner

*Primary Examiner*—Truc Nguyen
(74) *Attorney, Agent, or Firm*—Patents & TMB, P.C.

(57) ABSTRACT

Disclosed herein is a card adapter for electrically connecting electrical connecting portions of a card-shaped electronic device such as a CF card to contacts in a slot for a PC card provided in a personal computer. The card adapter 1 includes a chassis 10, a pair of conducting plates 40 provided on the upper and lower sides of the chassis 10, and a grounding member 20, and the like. The grounding member 20 is used to provide an electrical path for electrically connecting a grounding contact portion of the CF card to a grounding part of the slot without using the conducting plates 40 and it is formed into a single part. By using such a grounding member 20, the card adapter 1 can directly connect the grounding contact portion of the CF card to the grounding part of the slot to accomplish stable and reliable grounding.

9 Claims, 5 Drawing Sheets

CARD ADAPTER

BACK GROUND OF THE INVENTION

1. Field of the Invention

This invention relates to a card adapter for electrically connecting electrical connecting portions of a card-shaped electronic device to contacts in a slot provided in a personal computer or the like for receiving another card-shaped electronic device which is manufactured in accordance with a different standard.

2. Description of the Prior Art

A card adapter has been conventionally used, for example, for electrically connecting contacts of a CF (Compact Flash) card which is a card-shaped electronic device smaller than a PC card to contacts (contact pins) in a slot provided in a personal computer for receiving a PC card.

An example of this kind of conventional card adapter is shown in FIG. 5. A card adapter 50 shown in FIG. 5 is generally constructed from a chassis 51 formed of a resin or the like, a circuit board assembly 52 mounted on the chassis 51, and a pair of conducting plates 53, 53 provided on the upper and lower sides of the chassis 51, respectively.

The chassis 51 has a CF card receiving space 54 for receiving the CF card therein. The circuit board assembly 52 is provided with a first connector 55 to be electrically connected to the contacts (contact pins) provided in the slot for a PC card, a second connector 56 to be electrically connected to the contacts of the CF card an eject button (eject lever) 57 and an eject arm 58 used when ejecting the CF card received in the CP card receiving space 54.

The eject button 57 is disposed in the chassis 51 such that it can be moved along the longitudinal direction of the adapter. The eject arm 58 is pivotably mounted on the circuit board assembly 52 by means of a rotation axle 59. Further, the tip portion of the eject button 57 is linked with one end of the eject arm 58 through a connection 60.

When ejecting the CF card received in the CF card receiving space 54, eject operation is carried out by pushing the eject button 57 into the chassis 51. When the eject button 57 is pushed, the eject arm 58 is rotated about the rotation axle 59, and the other end portion thereof (which is an end portion opposite to the end portion linked with the eject button 57) is moved toward the inside of the CF card receiving space 54, and as a result, the CF card is disconnected from the card adapter 1 by the eject arm 58.

Further, the CF card is provided with grounding contact portions (not shown in the drawings) on the side surfaces thereof for discharging static electricity charged in the CF card, and the chassis 51 is also provided with an electrical path for discharging the static electricity from the grounding contact portion of the CF card to a grounding means of the slot for a PC card.

The electrical path is constructed from an elastic contacting part 61 which elastically contacts with the grounding contact portion of the CF card, a contact part 62 which electrically connects with the grounding means of the slot for a PC card, and the conducting plate 53 which electrically connects the elastic contacting part 61 and the contact part 62.

As described above, in the conventional card adapter 50, the electrical path for discharging static electricity from the grounding contact portion of the CF card to the grounding means of the slot for a PC card is constructed from the three parts including the elastic contacting part 61, the contact part 62, and the conducting plate 53, and these three parts are electrically connected by merely contacting them with each other.

For this reason, when the card adapter 50 is used, there is the case that such an electrical path is interrupted or broken because poor contact occurs at any contact portion between the parts due to deformation of the parts by external forces or deterioration with the lapse of time such as the generation of rust on the contact surfaces of the parts.

SUMMARY OF THE INVENTION

In view of the problem described above, it is an object of the present invention to provide a card adapter which can stably and reliably connect a grounding contact portion of a card-shaped electronic device to a grounding means of a slot provided in a personal computer or the like for receiving another card-shaped electronic device which is manufactured in accordance with a different standard.

In order to achieve the object mentioned above, the present invention is directed to a card adapter for electrically connecting a plurality of electrical connecting portions of a card-shaped electronic device to a plurality of contacts provided in a slot for receiving another card-shaped electronic device which is manufactured in accordance with a different standard, the card-shaped electronic device having a grounding contact portion and the slot having a grounding means, said card adapter comprising:

- a first connector to be electrically connected to the contacts provided in the slot;
- a second connector which is electrically connected to said first connector, said second connector being adapted to be connected to the electrical connecting portions of the card-shaped electronic device;
- a chassis in which said first and second connectors are disposed, said chassis having upper and lower sides;
- a pair of conducting plates provided on the upper and lower sides of the chassis, respectively; and
- an electrical path for electrically connecting the grounding contact portion of the card-shaped electronic device to the grounding means of the slot without using the conducting plates.

As described above, the card adapter according to the present invention has the electrical path for electrically connecting the grounding contact portion of a card-shaped electronic device to the grounding means of the slot provided in a personal computer for receiving another card-shaped electronic device which is manufactured in accordance with a different standard without using the conducting plates. Therefore, according to the present invention, it is possible to obtain a card adapter which can connect the grounding contact portion of a card-shaped electronic device to the grounding means of the slot in a personal computer stably and reliably irrespective of the condition of the conducting plates.

In the present invention described above, it is preferred that the electrical path includes a grounding member which is adapted to contact with the grounding contact portion of the card-shaped electronic device and the grounding means of the slot, respectively.

Further, it is also preferred that said chassis has a pair of arms which extend from portions of the chassis which are located at opposite sides of the second connector, respectively, with a space therebetween so as to define a receiving space for the card-shaped electronic device, and the card-shaped electronic device having a side surface which faces one of said arms when the card-shaped electronic device is received in the receiving space, and the grounding contact portion of the card-shaped electronic device is provided on the side surface, and the grounding means of the slot is arranged at a position that is in contact with a part of a side surface of the card adapter when the card adapter is inserted into the slot in which the grounding member is arranged so that the grounding contact portion of the card-shaped electronic device is electrically connected to the grounding means of the slot when the card adapter in which the card-shaped electronic device has been connected to the second connector is inserted into the slot.

Furthermore, it is also preferred that the grounding member includes an elastic contacting part which can elastically contact with the grounding contact portion of the card-shaped electronic device when the device is connected to the second connector, a contact part which can electrically connect with the grounding means of the slot when the card adapter is inserted into the slot, and a connecting part which connects the elastic contacting part and the contact part, and the elastic contacting part, the contact part and the connecting part are integrally formed into a single part.

In this case, it is also preferred that the elastic contacting part is arranged on an inner surface of the arm, and the contact part is arranged on an outer surface of the arm.

In the present invention, it is preferred that said grounding member is arranged with being isolated from the conducting plates.

Further, it is also preferred that the card-shaped electronic device is one selected from the group consisting of a semiconductor memory card, an interface card and a hard disk.

The above and other objects, structures and effects will be more apparent from the following detailed description of the embodiment with reference to the appended drawings.

DETAILED DESCRIPTION OF THE INVENTION

Hereinbelow, a preferred embodiment of a card adapter according to the present invention will be described in detail with reference to the appended drawings.

Figure 1:
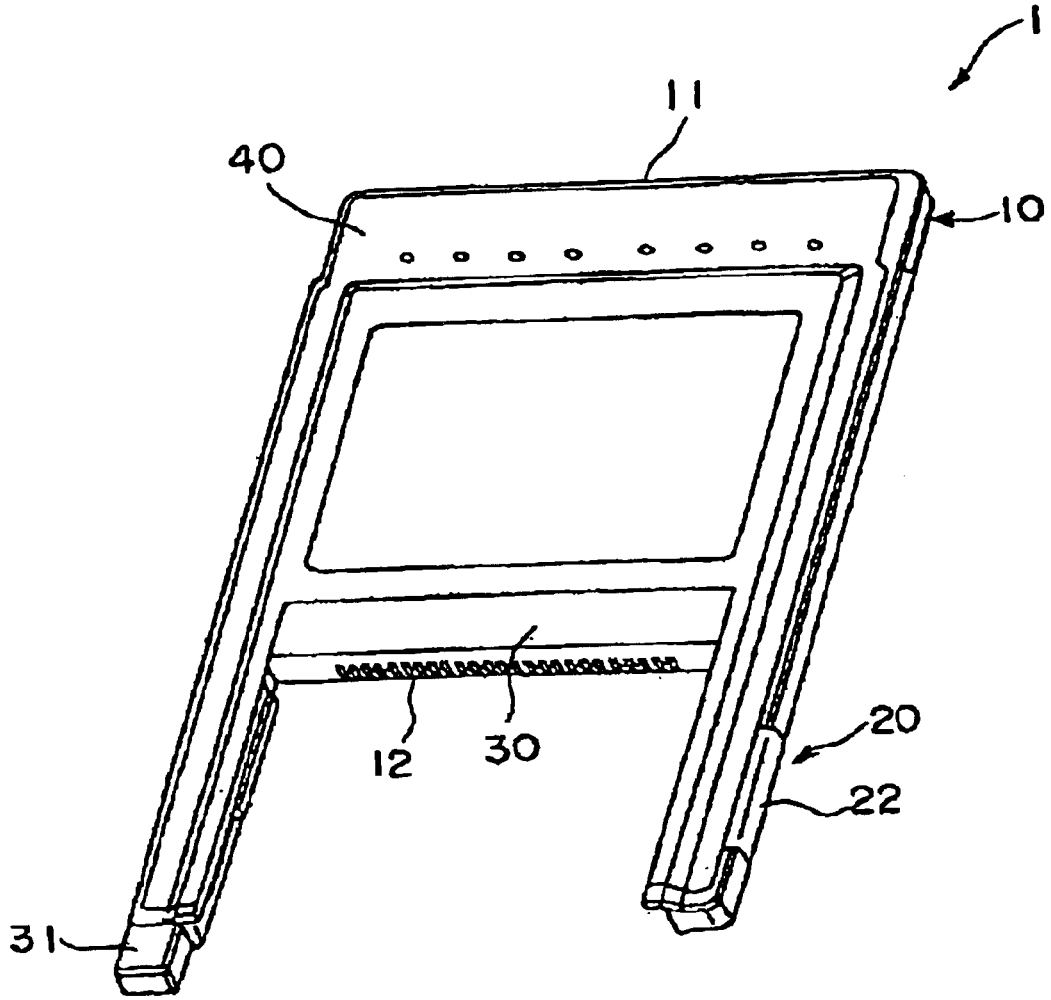
FIG. 1 is a perspective view which shows the overall structure of a card adapter according to the present invention.
Figure 2:
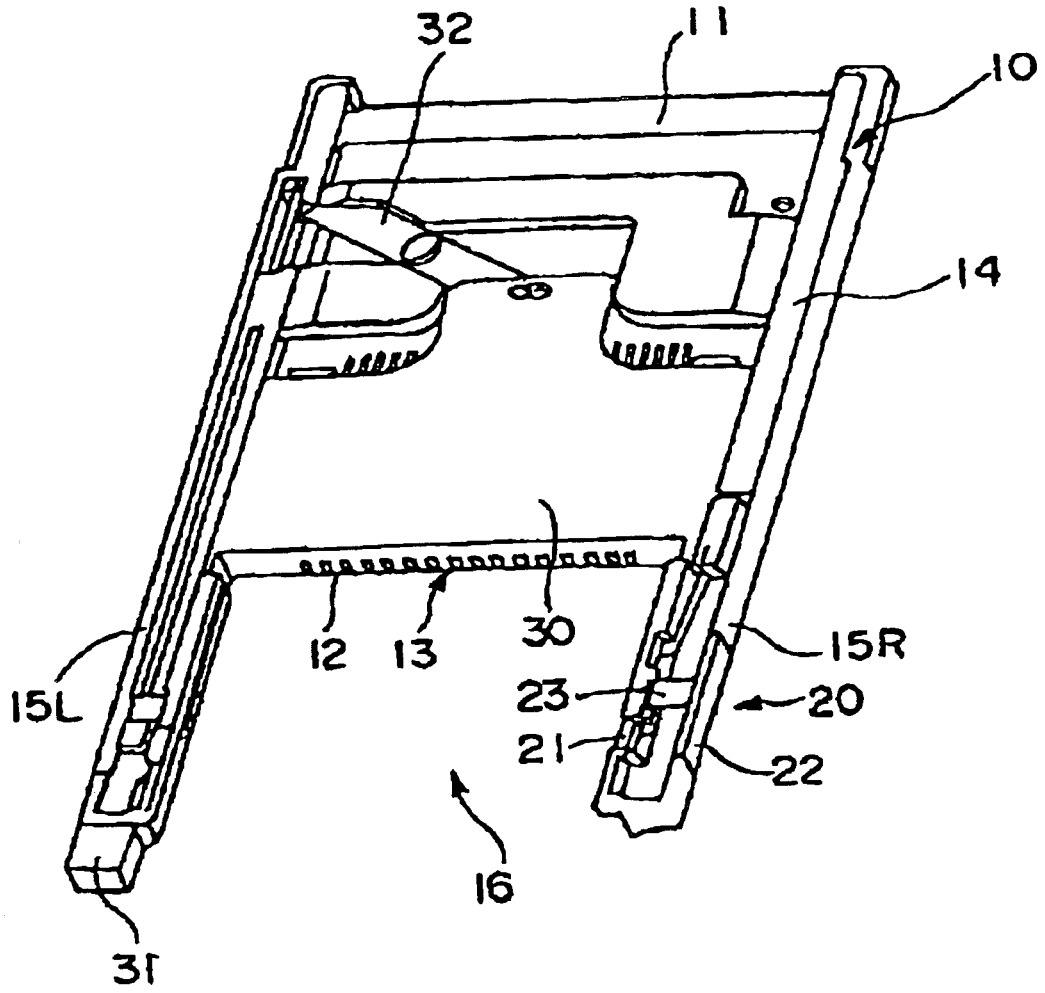
FIG. 2 shows the state in which conducting plates are removed from the card adapter according to the present invention.
Figure 3:
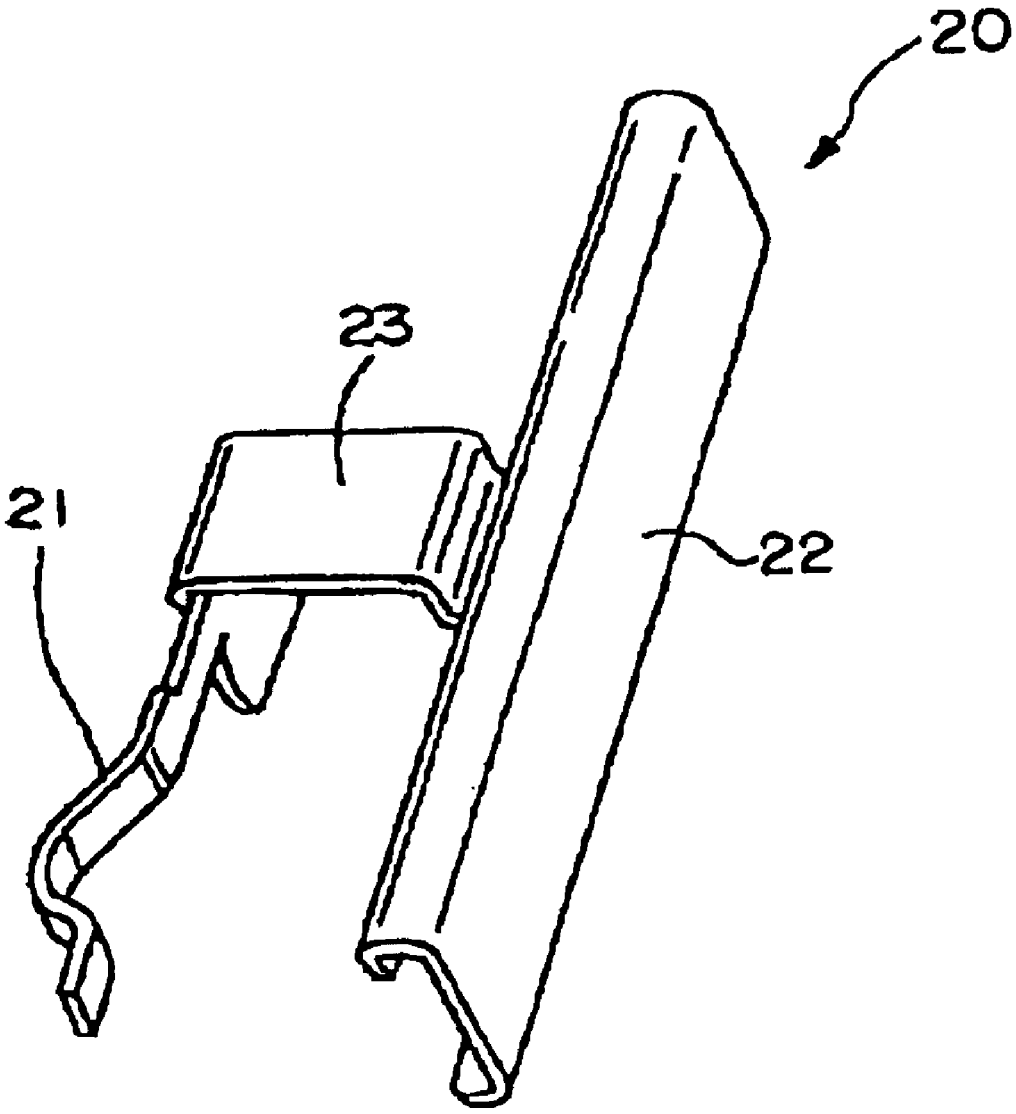
FIG. 3 is a perspective view which shows a grounding member of the card adapter according to the present invention.
Figure 4:
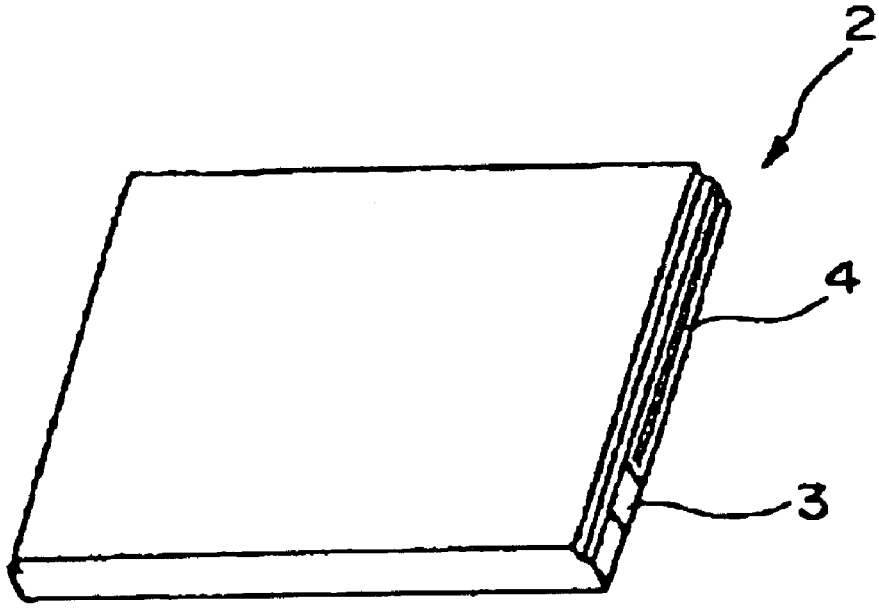
FIG. 4 is a perspective view which shows a CF card to be connected to the card adapter according to the present invention.
Figure 5:
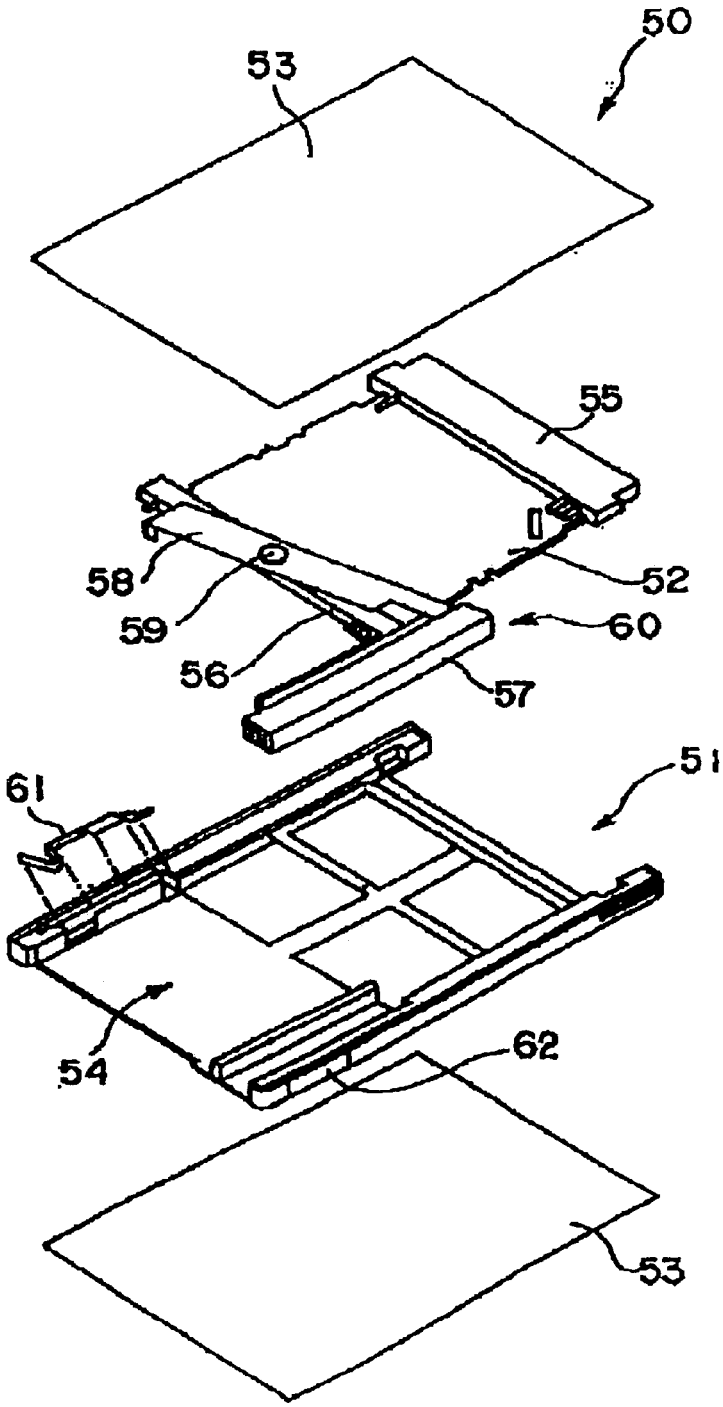
Fig. 5 Prior Art
FIG. 5 is an exploded perspective view which shows the structure of a conventional card adapter.

FIG. 1 is a perspective view which shows the overall structure of an embodiment of the card adapter according to the present invention; FIG. 2 shows the state in which conducting plates are removed from the card adapter; FIG. 3 is a perspective view which shows a grounding member of the card adapter; and FIG. 4 is a perspective view which shows a CF card to be connected to the card adapter.

The card adapter according to the present invention is used for, for example, electrically connecting a plurality of electrical connecting portions of a card-shaped electronic device such as a CF (Compact Flash (which is a trade mark of SanDisk Corporation)) card to a plurality of contacts in a slot provided in a personal computer or the like for receiving another card-shaped electronic device such as a PC card which is manufactured in accordance with a different standard from the CF card. In this regard, it is to be noted that the following description for the embodiment will be made with regard to the case where the card adapter according to the present invention is used for electrically connecting electrical connecting portions of a CF card to contacts (contact pins) provided in a slot for a PC card.

As shown in FIG. 1 and FIG. 2, a card adapter 1 includes a first connector 11 to be electrically connected to the contacts provided in the slot for a PC card (not shown in the drawings); a second connector 12 which is electrically connected to the first connector 11 and is adapted to be connected to the electrical connecting portions of a CF card 2; a chassis 10 in which the first and second connectors 11, 12 are disposed; a pair of conducting plates 40 provided on the upper and lower sides of the chassis 10, respectively; and an ejecting mechanism used when the CF card 2 is ejected. The ejecting mechanism includes a push member 30, an arm 32 and an eject lever 31.

The chassis 10 is formed of an insulating material such as a resin or the like. As shown in FIG. 2, the chassis 10 is formed to have a roughly rectangular shape, and it includes a main body 14 provided with the first connector 11 on its one end and the second connector 12 on its another end, and a pair of arms 15L and 15R which extend from portions of the main body 14 of the chassis which are located at opposite sides of the second connector 12, respectively, with a space therebetween so as to define a CF card receiving space 16 (which will be described later).

As shown in FIG. 4, the CF card 2 is a card-shaped electronic device having a roughly square shape. In one end surface of the CF card 2 which is positioned on the upper side in FIG. 4, there are formed with electrical connecting portions (not shown in drawings) to be electrically connected to contact pins of the second connector 12 of the card adapter 1. Further, in the left and right side surfaces (which are positioned in the left and right sides in FIG. 4) of the CF card 2, that is, in the side surfaces which are in contact with the arms 15L and 15R, respectively, when the CF card 2 is received in the CF card receiving space 16 of the chassis 10, there are formed with grounding contact portions 3. One of the grounding contact portions 3 is adapted to be electrically connected to a grounding member 20 (which will be described below) for discharging static electricity charged in the CF card 2. Further, on the side surfaces of the CF card 2, there are also formed with guiding grooves 4 for guiding the CF card 2 when inserting the CF card 2 into the CF card receiving space 16.

The grounding member 20 is mounted on the arm 15R of the chassis 10 so as to provide an electrical path for electrically connecting the grounding contact portion 3 of the CF card 2 to a grounding means (not shown in the drawings) provided in the slot for a PC card without using the conducting plates 40.

The grounding member 20 electrically connects the grounding contact portion 3 to the grounding means of the slot for a PC card when the card adapter 1 in which the CF card 2 has been connected to the second connector 12 is inserted into the slot.

The grounding member 20 is formed from a conductive material such as a metal plate or the like. More specifically, the grounding member 20 includes an elastic contacting part 21 which elastically contacts with the grounding contact portion 3 of the CF card 2, a contact part 22 which electrically connects with the grounding means of the slot for a PC card, and a connecting part 23 which connects the elastic contacting part 21 and the contact part 22. The elastic contacting part 21, the contact part 22, and the connecting part 23 are integrally formed into a single part by punching out a conductive material such as a metal plate or the like and then bending it into a predetermined shape as shown in FIG. 3. Namely, the elastic contacting part 21 and the contact part 22 are respectively bent downwardly so as to be roughly perpendicular to the connecting part 23.

The grounding member 20 having the above structure is mounted on the arm 15R such that the elastic contacting part 21 is positioned on the inner surface of the arm 15R (that is, on the surface which defines the CF card receiving space 16), the contact part 22 is positioned on the outer surface of the arm 15R and the connecting part 23 is positioned on the upper surface of the arm 15R.

Further, as shown in FIG. 2, the elastic contacting part 21 is formed to have a curved portion which protrudes toward the CF card receiving space 16 from the inner surface of the arm 15R to form an elastic electrical contact. Therefore, when the CF card 2 is received in the CF card receiving space 16 to electrically connect the electrical connecting portions of the CF card 2 to the second connector 12 of the card adapter 1, the grounding contact portion 3 of the CF card 2 elastically contacts with the curved portion (electrical contact) of the elastic contacting part 21.

As shown in FIG. 3, the contact part 22 is formed into a plate-like shape and its opposite longitudinal edges are bent so that it has a roughly C-shaped cross section. As described above, the grounding member 20 is mounted on the arm 15R of the chassis 10 such that the contact part 22 is arranged on the outer surface of the arm 15R, that is, the contact part 22 is arranged on the surface of the arm 15R which faces with an inner side surface of the slot for a PC card. Further, the contact part 22 is arranged at a position that is in contact with the grounding means provided in the slot when the card adapter 1 is inserted into the slot to electrically connect the contacts of the first connector 11 of the card adapter 1 to the contact pins provided in the slot. In this regard, it is to be noted that the length of the contact part 22 is preferably set at a predetermined length (e.g., 1 cm). In order to accomplish a stable contact between the contact part 22 and the grounding means provided in the slot.

The grounding member 20 having the above structure functions to electrically connect the grounding contact portion 3 of the CF card 2 to the grounding means of the slot for a PC card directly, when the card adapter 1 in which the CF card 2 has been connected to the second connector 12 is inserted into the slot.

As described above, in this embodiment, the connecting part 23 is arranged on the upper surface of the arm 15R, when the grounding member 20 is mounted on the arm 15R of the chassis 10. Further, the upper conducting plate 40 is provided on the connecting part 23. Therefore, the upper surface of the connecting part 23 is coated with an insulation material so that the grounding member 20 is isolated from the conducting plate 40. By doing so, it is possible to prevent static electricity charged in the human body from running into the grounding contact portion 3 of the CF card 2 through the conducting plates 40 and the grounding member 20 of the card adapter 1.

As described above, the card adapter 1 of the present embodiment has the electrical path for directly connecting the grounding contact portion 3 of the CF card 2 to the grounding means of the slot for a PC card without using the conducting plates 40. Therefore, the card adapter 1 of the present embodiment can stably and reliably connect the grounding contact portion 3 of the CF card 2 to the grounding means of the slot irrespective of the condition of the conducting plates 40.

Further, as described above, in this embodiment, the grounding contact portion 3 of the CF card 2 is directly connected to the grounding means of the slot for a PC card through the grounding member 20 in the form of a single part when the card adapter 1 to which the CF card 2 has been connected is inserted into the slot. This makes it possible to avoid the problems which would be caused when the electrical path is formed from a plurality of parts like the prior art described above. Namely, it is possible to avoid the case that poor contact occurs due to deformation of the parts caused by external forces, or deterioration with the lapse of time or soiling at contact portions between the metallic parts constituting the electrical path. Therefore, according to the card adapter 1 of the present embodiment it is possible to reliably discharge static electricity from the grounding contact portion 3 of the CF card 2 to the grounding means of the slot for a PC card without such interruption or breakage of the electrical path as described above.

Finally, the present invention is not limited to the above embodiment, and various modifications or changes may be made without departing from the scope of the present invention as defined by the appended claims. For example, it goes without saying that the present Invention may be applied to card adapters other than the card adapter for CF card or PC card. Examples of card-shaped electronic devices that can be used for the card adapter of the present invention include a semiconductor memory card, an interface card and a hard disk and the like.

What is claimed is:

1. A card adapter for electrically connecting a plurality of electrical connecting portions of a card-shaped electronic device to a plurality of contacts provided in a slot, the card-shaped electronic device having a grounding contact portion and the slot having a grounding means, said card adapter comprising:

a first connector to be electrically connected to the contacts provided in the slot;

a second connector which is electrically connected to said first connector, said second connector being adapted to be connected to the electrical connecting portions of the card-shaped electronic device;

a chassis in which said first and second connectors are disposed, said chassis having upper and lower sides;

a pair of conducting plates provided on the upper and lower sides of the chassis, respectively; and a grounding member for electrically and directly connecting the grounding contact portion of the card-shaped electronic device to the grounding means of the slot wherein said grounding member includes parts which are adapted to contact with the grounding contact portion of the card-shape electronic device and the grounding means of the slot, respectively, and said grounding member is isolated from the conducting plates.

2. The card adapter as claimed in claim 1, wherein said chassis has a pair of arms which extend from portions of said chassis which are located at opposite sides of said second connector, respectively, with a space therebetween so as to define a receiving space for receiving the card-shaped electronic device, and the card-shaped electronic device having a side surface which faces one of said arms when the card-shaped electronic device is connected to the second connector and the grounding contact portion of the card-shaped electronic device is provided on the side surface thereof, and the grounding means of the slot is arranged at a position that is in contact with a part of the side surface of one of the arms of the card adapter when the card adapter is inserted into the slot, in which the grounding member is arranged on the arm so that the grounding contact portion of the card-shaped electronic device is electrically connected to the grounding means of the slot when the card adapter in which the card-shaped electronic device has been connected to the second connector is inserted into the slot.

3. The card adapter as claimed in claim 2, wherein the grounding member includes an elastic contacting part which can elastically contact with the grounding contact portion of the card-shaped electronic device when the device is connected to the second connector, a contact part which can electrically connect with the grounding means of the slot when the card adapter is inserted into the slot, and a connecting part which connects the elastic contacting part and the contact part, and the elastic contacting part, the contact part and the connecting part are integrally formed into a single part.

4. The card adapter as claimed in claim 3, wherein said arm has an inner surface and an outer surface, and the elastic contacting part is arranged on the inner surface of the arm, and the contact part is arranged on the outer surface of the arm.

5. The card adapter as claimed in claim 1, wherein the card-shaped electronic device is one selected from the group consisting of a semiconductor memory card, an interface card and a hard disk.

6. The card adapter as claimed in claim 1, wherein the grounding member includes an elastic contacting part which can elastically contact with the grounding contact portion of the card-shaped electronic device when the device is connected to the second connector, a contact part which can electrically connect with the grounding means of the slot when the card adapter is inserted into the slot, and a connecting part which connects the elastic contacting part and the contact part, and the elastic contacting part, the contact part and the connecting part are integrally formed into a single part.

7. The card adapter as claimed in claim 2, wherein said connecting part has an upper surface which faces one of the conducting plates, and the upper surface of the connecting part of the grounding member is coated with an insulation material so that the grounding member is isolated from the conducting plate.

8. A card adapter for electrically connecting a plurality of electrical connecting portions of a card-shaped electronic device to a plurality of contacts provided in a slot of a personal computer for receiving another card-shaped electronic device which is manufactured in accordance with a different standard from the card shaped electronic device, the card-shaped electronic device having a grounding contact portion and the slot having a grounding means, said card adapter comprising:

a first connector to be electrically connected to the contacts provided in the slot;

a second connector which is electrically connected to said first connector, said second connector being adapted to be connected to the electrical connecting portions of the card-shaped electronic device;

a chassis in which said first and second connectors are disposed, said chassis having upper and lower sides, and said chassis having a pair of arms which extend from the opposite sides of said second connector with a space therebetween so as to define a receiving space for receiving the card-shaped electronic device;

a pair of conducting plates provided on the upper and lower sides of the chassis, respectively; and an electrical path for electrically and directly connecting the grounding contact portion of the card-shaped electronic device to the grounding means of the slot without using the conducting plates, wherein said electrical path includes a grounding member which is adapted to contact with the grounding contact portion of the card-shaped electronic device and the grounding means of the slot, respectively, and said grounding member is arranged on one of the arms with being isolated from the conductive plates, wherein the grounding member includes an elastic contacting part which can elastically contact with the grounding contact portion of the card-shaped electronic device when the device is connected to the second connector, a contact part which can electrically connect with the grounding means of the slot when the card adapter is inserted into the slot, and a connecting part which connects the elastic contacting part and the contact part, and the elastic contacting part, the contact part and the connecting part are integrally formed into a single part, wherein the card-shaped electronic device has a side surface which faces said arm when the card-shaped electronic device is connected to the second connector and the grounding contact portion of the card-shaped electronic device is provided on the side surface thereof, and the grounding means of the slot is arranged at a position that is in contact with the contact part of the grounding member of the card adapter when the card adapter is inserted into the slot, in which the grounding member is arranged on the arm so that the grounding contact portion of the card-shaped electronic device is electrically connected to the grounding means of the slot through the grounding member when the card adapter in which the card-shaped electronic device has been connected to the second connector is inserted into the slot.

9. The card adapter in claim 8 wherein said connecting part has an upper surface which faces one of the conducting plates, and the upper surface of the connecting part of the grounding member is coated with an insulation material so that the grounding member is isolated from the conducting plate.

* * * * *

UNITED STATES PATENT AND TRADEMARK OFFICE

CERTIFICATE OF CORRECTION

PATENT NO. : 6,824,431 B2
DATED : November 30, 2004
INVENTOR(S) : Shimada et al.

It is certified that error appears in the above-identified patent and that said Letters Patent is hereby corrected as shown below:

Title page,
Item [73], Assignee, change “Electrical” to -- Electric --

Column 1,
Line 32, change “CP” to -- CF --

Column 5,
Line 45, change “(e.g., 1 cm). In order” to -- (e.g., 1 cm) in order --

Column 6,
Line 30, change “Invention” to -- invention --

Signed and Sealed this

Third Day of May, 2005

JON W. DUDAS
*Director of the United States Patent and Trademark Office*